US007864126B2

(12) United States Patent
Boisbouvier et al.

(10) Patent No.: US 7,864,126 B2
(45) Date of Patent: Jan. 4, 2011

(54) TRANSMITTING/RECEIVING ANTENNA WITH RADIATION DIVERSITY

(75) Inventors: Nicolas Boisbouvier, Evian les Bains (FR); Jean-Francois Pintos, Bourgbarre (FR); Philippe Minard, Saint Medard sur Ille (FR)

(73) Assignee: Thomson Licensing, Boulogne-Billancourt (FR)

( * ) Notice: Subject to any disclaimer, the term of this patent is extended or adjusted under 35 U.S.C. 154(b) by 13 days.

(21) Appl. No.: 12/083,306

(22) PCT Filed: Oct. 18, 2006

(86) PCT No.: PCT/FR2006/051054

§ 371 (c)(1),
(2), (4) Date: Apr. 9, 2008

(87) PCT Pub. No.: WO2007/048958

PCT Pub. Date: May 3, 2007

(65) Prior Publication Data

US 2009/0121953 A1 May 14, 2009

(30) Foreign Application Priority Data

Oct. 27, 2005 (FR) ..... 05 53272

(51) Int. Cl.
*H01Q 13/10* (2006.01)

(52) U.S. Cl. ..... 343/770; 343/769; 343/767; 343/700 MS; 343/876

(58) Field of Classification Search ..... 343/767, 343/769, 876, 821, 770, 778, 700 MS
See application file for complete search history.

(56) References Cited

U.S. PATENT DOCUMENTS 4,800,393 A * 1/1989 Edward et al. ..... 343/821

(Continued)

FOREIGN PATENT DOCUMENTS

EP 0713262 5/1996

(Continued)

OTHER PUBLICATIONS

Patent Abstracts of Japan, vol. 2003, No. 12, Dec. 5, 2003 & JP 2005-045494 (Hitachi Cable Ltd.).

(Continued)

*Primary Examiner*—Jacob Y Choi
*Assistant Examiner*—Kyana R Robinson
(74) *Attorney, Agent, or Firm*—Robert D. Shedd; Jeffrey M. Navon

(57) ABSTRACT

The present invention relates to a transmission/reception antenna with diversity of radiation comprising on a substrate at least a first and a second radiating elements connected by a network of feeder lines to a transmission/reception circuit of electromagnetic signals, wherein the network is constituted by a first feeder line connected to a first radiating element and by a set of two second feeder lines each connected by means of a switching element to the second radiating element in such a manner as to supply the two radiating elements in phase or in phase opposition, the set of the two second feeder lines being connected to the first feeder line by a third feeder line, the first and third feeder lines being connected by a feeder line common to the transmission/reception circuit of electromagnetic signals.

10 Claims, 5 Drawing Sheets

U.S. PATENT DOCUMENTS

| | | | | |
|---|---|---|---|---|
| 6,674,340 | B2 * | 1/2004 | Quan et al. | 333/164 |
| 6,816,116 | B2 * | 11/2004 | Chen | 342/372 |
| 6,891,510 | B2 * | 5/2005 | Le Bolzer et al. | 343/767 |
| 2003/0179138 | A1 | 9/2003 | Chen | |
| 2003/0193377 | A1 | 10/2003 | Quan et al. | |

FOREIGN PATENT DOCUMENTS

| | | |
|---|---|---|
| EP | 1662611 | 5/2006 |
| JP | 2005-45494 | 12/2003 |
| JP | 2005045494 | 2/2005 |

OTHER PUBLICATIONS

Search Report Dated Jan. 29, 2007.

* cited by examiner a)

b)

TRANSMITTING/RECEIVING ANTENNA WITH RADIATION DIVERSITY

This application claims the benefit, under 35 U.S.C. §365 of International Application PCT/FR2006/051054, filed Oct. 18, 2006, which was published in accordance with PCT Article 21(2) on May 3, 2007 in French and which claims the benefit of French patent application No. 0553272, filed Oct. 27, 2005.

The present invention relates to transmission/reception antennas with diversity of radiation.

Within the context of wireless networks, the applicant proposed several solutions enabling the problems of fading or significant degradation of the signal due to multiple paths to be solved. The applicant thus proposed, in the French patent application no. 01 10696, an antenna topology with diversity of radiation based on antennas of the annular slot type fed selectively. However, this type of antenna has directivities in the order of 3 or 4 dB. However, for applications of the WADSL type (Wireless ADSL), a significant directivity is necessary. Indeed, within the context of an indoor transmission/reception of a signal of this type, the constraints on the system loss are extremely high through the effect of the penetration of the signal within dwellings, which creates an attenuation of several dB in this signal. In order not to increase the cost of such a solution through the use of an amplifier, the increase in the antenna directivity is one solution. Moreover, to combat the phenomena resulting from existing multiple paths, for example for applications of the WADSL type, the use of diversity is necessary. A solution is proposed here using at the same time the diversity enabling multiple paths to be contended with, together with the directivity thus avoiding the addition of a more powerful but also more expensive amplifier.

Figure 1:
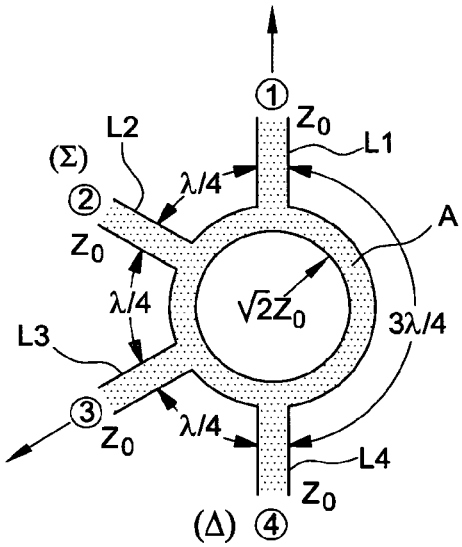

Currently, to produce antennas having a good directivity, a topology of the type of the one shown in FIG. 1 is used. This antenna topology in annular form is composed of sections of microstrip lines engraved on a dielectric substrate connected to radiating elements and to transmission/reception circuits of electromagnetic signals.

In a more specific manner, the device of FIG. 1 comprises a circular ring A realised by a microstrip line engraved on the substrate. Four sections of microstrip lines L1, L2, L3, L4 are connected to the ring A in such a manner that the distance between the two sections of outer microstrip lines (L1, L4) is equal to $3\lambda/4$ where $\lambda$ is the wavelength at the operating central frequency, whereas the distance between the other line sections (L1, L2; L2, L3; L3, L4) is equal to $\lambda/4$. A perimeter of the ring is thus obtained equal to $6\lambda/4$. These four line sections, each having an impedance Zo, form four accesses 1, 2, 3, 4. The accesses 1 and 3 are each connected to a radiating element not shown, whereas the accesses 2 and 4 are connected to feeder circuits. When the assembly is supplied by the access 2, the two radiating elements connected to the accesses 1 and 3 are supplied in phase, whereas when the assembly is supplied by the access 4, the two radiating elements connected to the accesses 2 and 3 are supplied in phase opposition. This hybrid ring, having two accesses, thus requires, the presence of a switching element, upstream of the ring, enabling the switching operation from one access to another. This topology is complex, difficult to implement and cumbersome owing to the fact that the antenna accesses and circuits are arranged in a staggered manner.

The present invention thus relates to a transmission/reception antenna with diversity of radiation that has a good directivity and that is, further, easy to implement.

The present invention relates to a transmission/reception antenna with diversity of radiation comprising on a substrate at least a first and a second radiating element connected by a network of feeder lines to a transmission/reception circuit of electromagnetic signals, characterized in that the network is constituted by a first feeder line connected to a first radiating element and by a set of two second feeder lines each connected by means of a switching element to the second radiating element in such a manner as to supply the two radiating elements in phase or in phase opposition. The set of the two second feeder lines is connected to the first feeder line by a third feeder line, the first and third feeder lines being connected by a common feeder line to the transmission/reception circuit of electromagnetic signals.

According to a first embodiment, the radiating elements are constituted by slot type antennas, more particularly annular slot or polygonal slot antennas. In this case, the slot type antennas are connected to the feeder lines by electromagnetic coupling, the feeder lines being constituted by microstrip lines etched on the face of the opposite substrate to the face carrying the slot type source-antennas.

According to another characteristic of the present invention, the first feeder line has a length equal to the length of one of the second feeder lines plus the length of the third feeder line.

According to another embodiment, the radiating elements are constituted by antennas of the patch type. In this case, the feeder lines are preferably constituted by microstrip lines etched on the face of the substrate carrying the patches.

Moreover, the switching elements are constituted for example by diodes, MEMS or micro electro mechanical systems, transistors or any other element fulfilling the switching function (commercial "switch" type). In the case of diodes, these are mounted head to tail and controlled by a same voltage.

Figure 4:
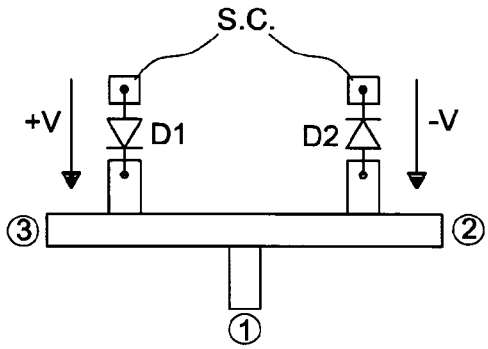
Figure 2:
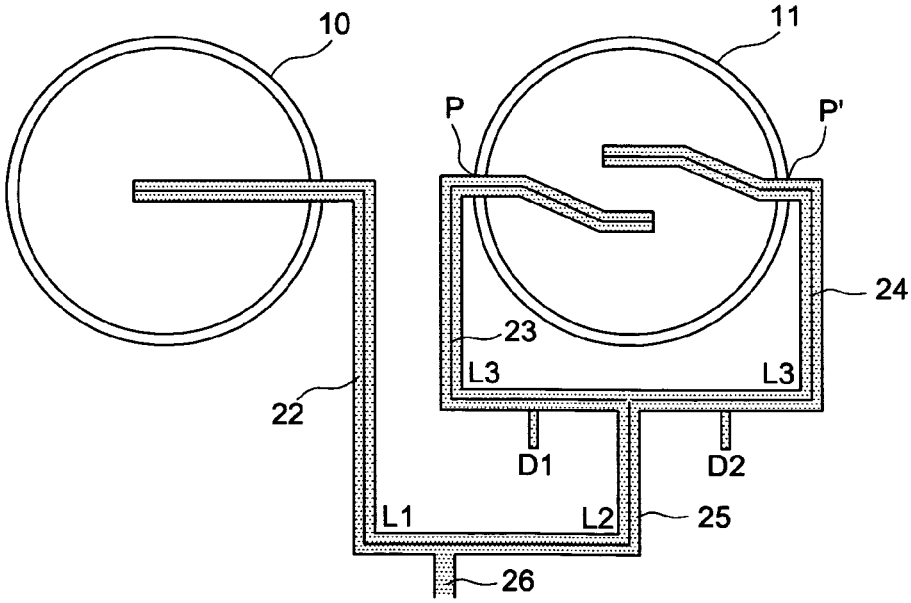
Figure 3:
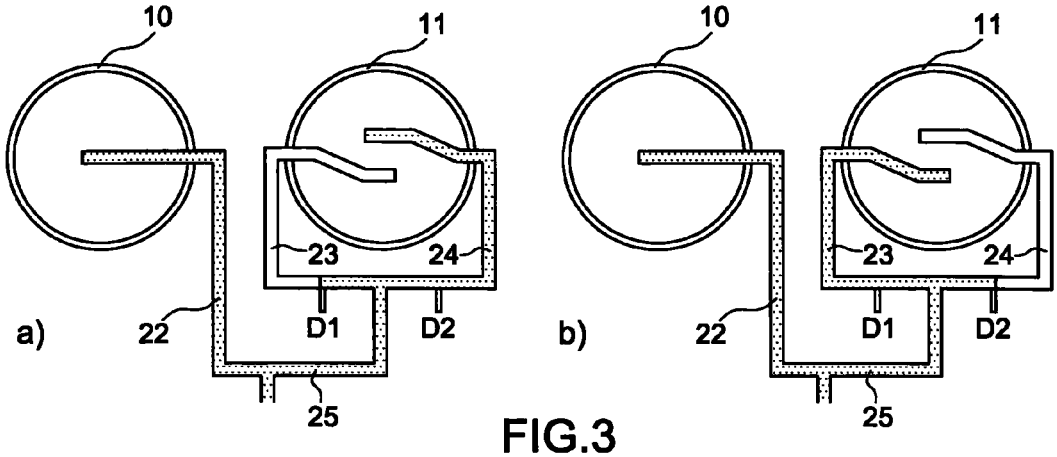
Figure 6:
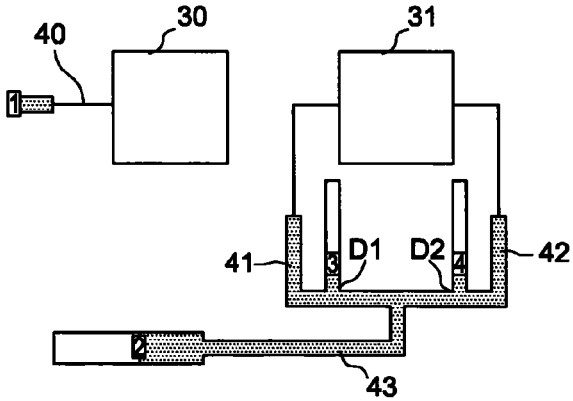
Figure 7:
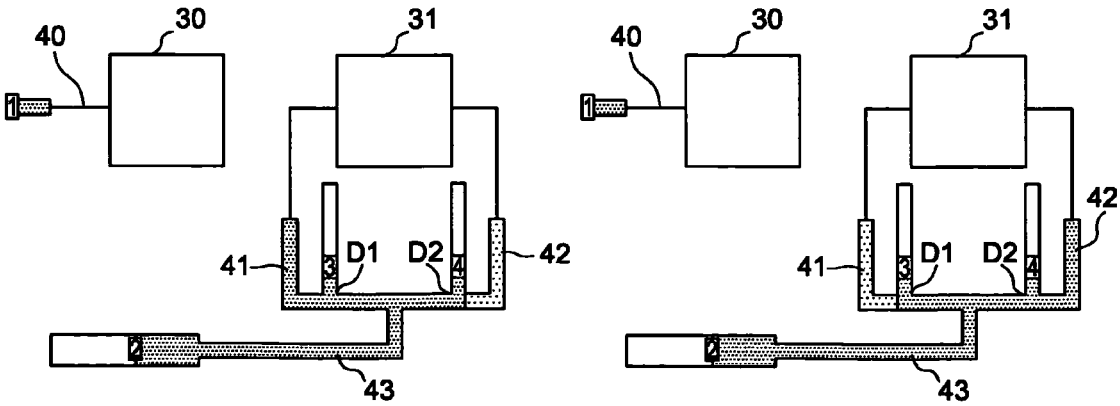
Figure 5:
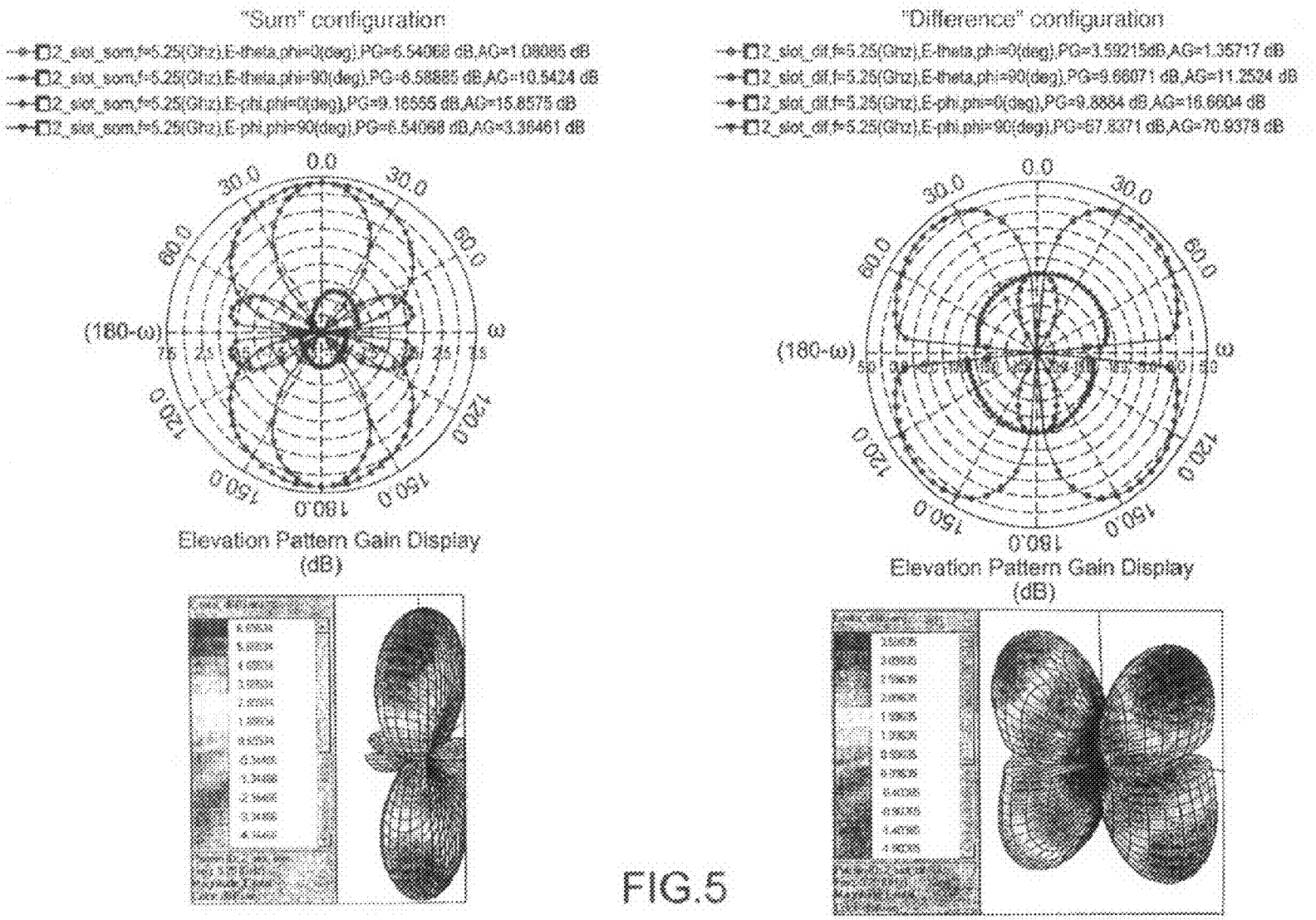
Figure 8:
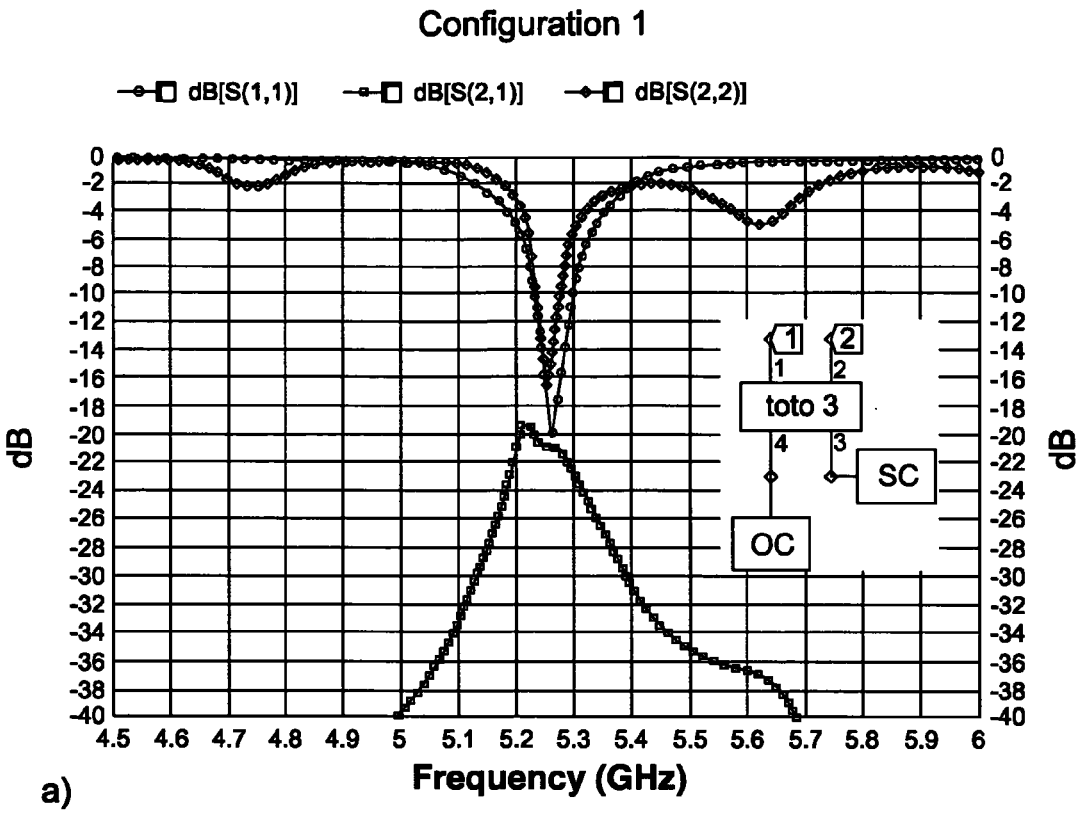
Figure 8:
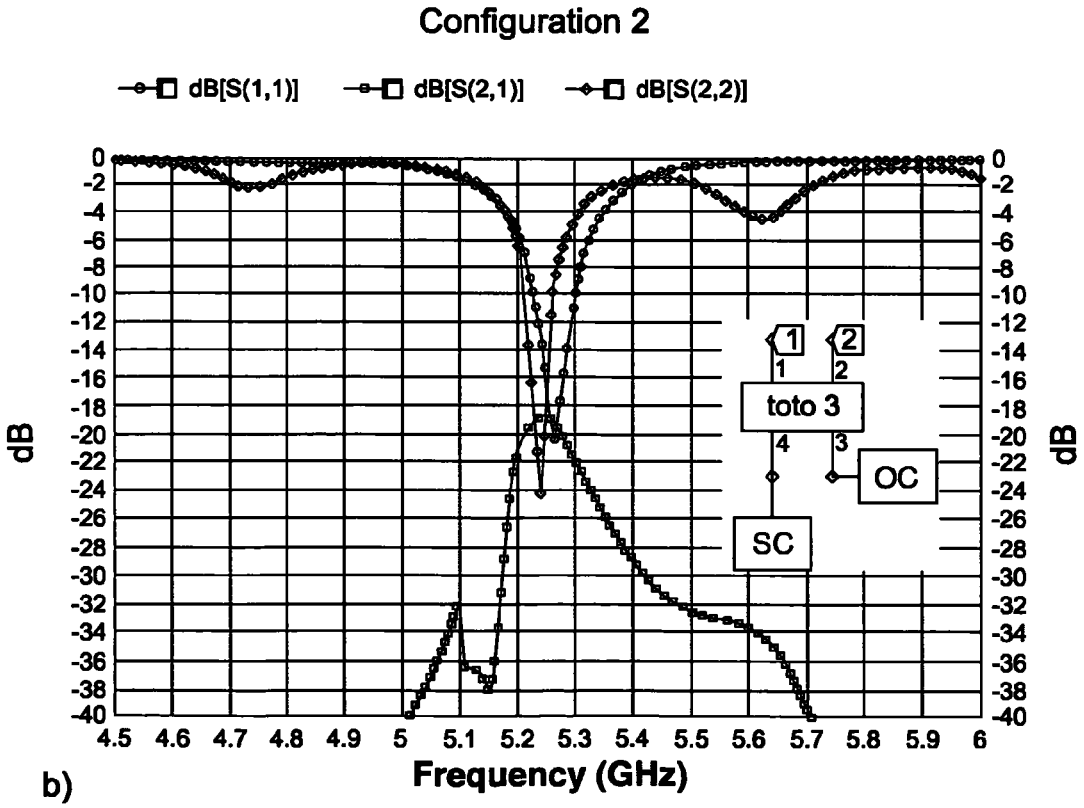
Figure 9:
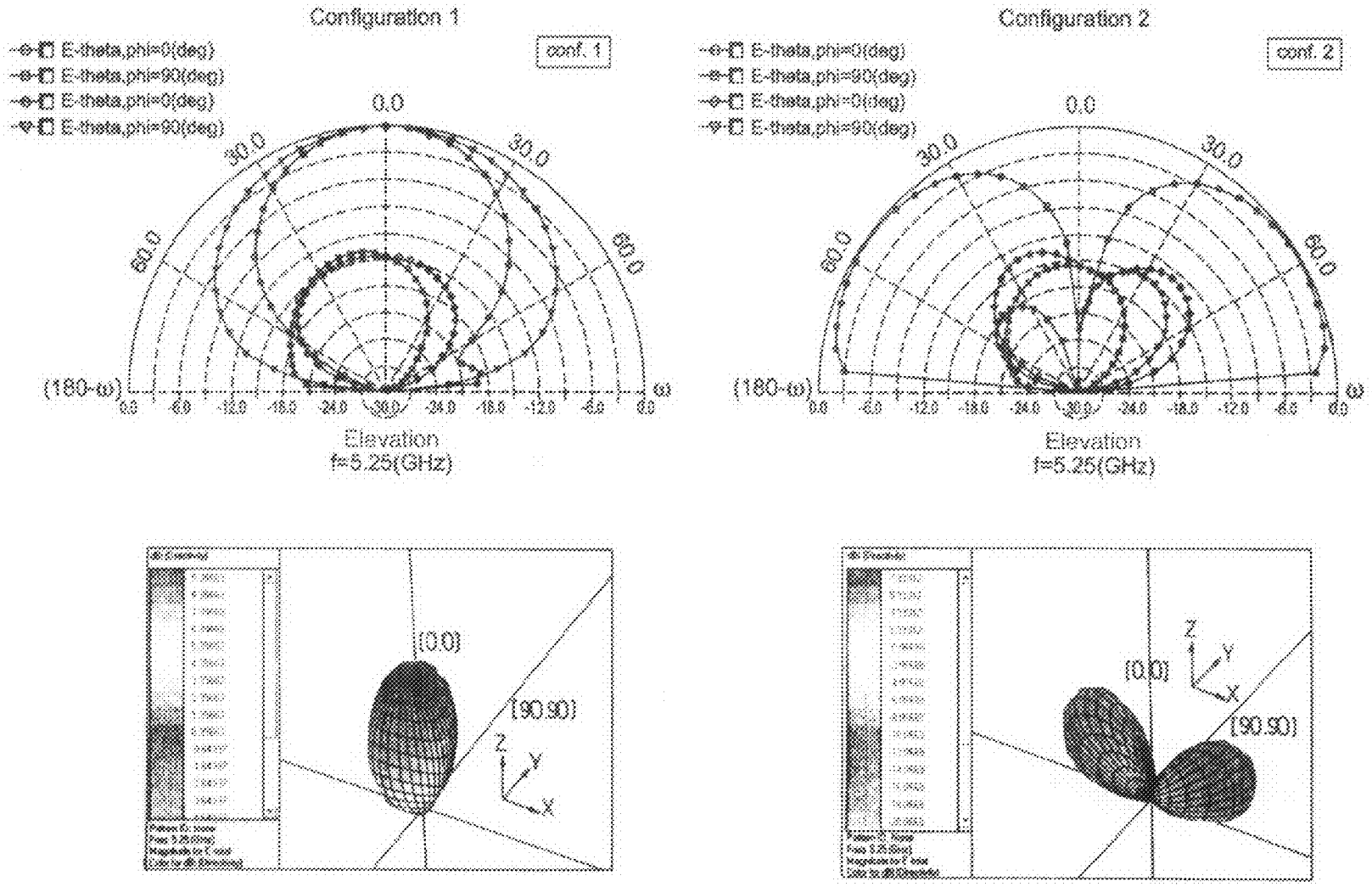

Other characteristics and advantages of the present invention will emerge upon reading the following description of different embodiments, this description being made with reference to the drawings attached in the appendix, in which:

FIG. 1 already described shows very diagrammatically an antenna topology according to the prior art, FIG. 2 is a block diagram view of a first embodiment of an antenna with diversity of radiation in accordance with the present invention, FIG. 3 is an identical view to that of FIG. 2 showing the two operating modes of the antenna in accordance with the present invention, FIG. 4 is a diagrammatic view explaining the assembly of the diodes, FIG. 5 shows the radiation pattern of the antennas according to the two configurations shown in FIG. 3, FIG. 6 is a block diagram view of a second embodiment of an antenna with diversity of radiation in accordance with the present invention, FIG. 7 is an identical view to that of FIG. 4 showing the two operating modes of the antenna in accordance with the present invention, FIG. 8 shows the impedance matching curves of the antenna according to the two configurations shown in FIG. 5, and FIG. 9 shows the radiation pattern of the antennas according to the two configurations shown in FIG. 5.

With reference to FIGS. 2 to 3, a first embodiment of an antenna with diversity of radiation compliant with the present invention will first be described. As shown diagrammatically in FIG. 2, the antenna comprises two radiating elements 10, 11 that are constituted by two annular slots realised in a known manner by etching the ground plane of a dielectric substrate. In the embodiment, the two annular slots have a diameter equal to kλs where λs is the wavelength in the slot at the chosen frequency. It is obvious for a person skilled in the art that the slots can be polygonal in shape and have different dimensions In this embodiment, the slot type antennas are fed by using a supply by electromagnetic coupling according to the known Knorr method. However, without leaving the scope of the present invention, other methods can be used such as the tangential supply of the slot. In a more specific manner and as shown in FIG. 2, the first antenna 10 is supplied by a line 22 realised on the face of the substrate opposite the face on which the annular slots are realised. The line 22 cuts the slot 10 at a length k'λm/4 of its extremity with λm the wavelength in the microstrip at the operating central frequency.

As shown in FIG. 2, the second annular slot 11 is supplied by a set of two feeder lines 23, 24. Said two feeder lines 23 and 24 are realised by microstrip lines etched on the face of the substrate opposite the face receiving the slot 11. As in the case of the first annular slot 10, the supply is realised by electromagnetic coupling according to the Knorr method, the lines 23 and 24 cross the slot at points P and P' being situated at a length k'λm/4 from their extremity. In this case, the crossing point P of the line 23 with the slot 11 and the crossing point P' of the line 24 with the slot 11 are diametrically opposed, in such a manner as to obtain a phase or phase opposition supply, as will be explained hereafter. The two feeder lines 23 and 24 are connected to a third feeder line 25 that is itself connected with the feeder line 22 to a common feeder line 26 enabling the set of lines to be connected to an electromagnetic wave transmission/reception circuit not shown.

Moreover, in accordance with the present invention, on each of the feeder lines 23 and 24, a diode D1 and diode D2 are mounted respectively. The diodes D1 and D2 are mounted head to tail and connected to a common voltage such that when one of the diodes is conducting, the other is non-conducting and vice versa. A diagrammatic representation of the mounting of the diodes is given in FIG. 4. As shown in the figure, the diode D1 is mounted conducting between a short circuit SC and a feeder line whereas the diode D2 is mounted conducting between the feeder line and the short circuit SC. Hence, to validate the access 2 (resp. 3), a negative voltage (resp. positive) must be applied to diode D2 (resp. D1), making D2 conducting (resp. non-conducting) and D1 non-conducting (resp. conducting).

In accordance with the present invention, the first feeder line 22 has a length L1 which, for optimum operation, is equal to the length L3 of the feeder line 25 plus the length L2 of one of the second feeder lines 23 or 24.

A description will now be made of the operation of the antenna with diversity of radiation of FIG. 2 with reference to FIG. 3.

Hence, as shown in part a) of FIG. 3, when the diode D1 is non-conducting, the diode D2 is conducting and the two annular slots 10 and 11 are supplied in phase, the supply of the slot 11 being realised by the lines 25 and 24. On the contrary, when, as shown in part b) of FIG. 3, the diode D2 is non-conducting and the diode D1 is conducting, the supply of the slot 11 is made by lines 25 and 23 and, in this case, the two annular slots 10 and 11 are supplied in phase opposition. One therefore obtains, in one case, either a radiation pattern corresponding to the sum of the two radiation patterns when the supply of the two annular slots is in phase or a radiation pattern corresponding to the difference of the two patterns when the supply of the two annular slots is in phase opposition. Hence, the diagrams of FIG. 5 show the "sum" and "difference" patterns obtained with the slot type antennas shown in FIG. 3. A directivity of 6.6 dB is noted for the "sum" pattern and 3.6 db for the "difference" pattern. The "sum" pattern has main lobes in the azimuthal plane, whereas the "difference" pattern has a null point in the azimuthal plane and main lobes in the +/−60° planes.

Another embodiment of the present invention will now be described with reference to FIGS. 6 to 9.

In this case, the two radiating elements realised on the substrate are constituted by two patches 30, 31 obtained by etching a ground plane of the substrate. These patches are dimensioned, in a known manner, to operate at the required frequency.

As shown in FIG. 6, the patch 30 is supplied by a feeder line 40 whereas the patch 31 is supplied by two feeder lines 41, 42 connected symmetrically on each side of the patch 31. These two feeder lines are connected to a common line 43.

In accordance with the present invention, on the feeder lines 41 and 42, provision is made for diodes D1, D2 respectively mounted head to tail and supplied by a common voltage.

With reference to FIG. 7, a description will also be given of the operation of the antenna shown in FIG. 4.

When the diode D2 mounted on the feeder line 42 is non-conducting and the diode D1 is conducting, as shown in part a) of FIG. 7, the two patches are supplied in phase whereas when, as shown in part b) of FIG. 7, the diode D1 mounted on the feeder line 41 is non-conducting and the diode D2 is conducting, the two patches are supplied in phase opposition.

A known software application was used to simulate an antenna with diversity of radiation whose radiating elements are patches, as shown in FIGS. 6 and 7. In this case, the two patches 30 and 31 have been dimensioned, in a known manner, to operate at 5.25 GHz and they have been grouped into a network as proposed above.

In FIG. 8, the impedance matching curves corresponding to the two configurations of FIG. 7 are shown. This figure shows the impedance matching curve S(1,1) of the patch 30, and the impedance matching curve S(2,2) of the patch 31. An impedance matching at best equal to the impedance matching observed for each of the patches is expected during the recombination of the ports 1 and 2. It will be noted that the associated bandwidth is directly related to the choice of the radiating element.

In FIG. 9, the radiation patterns of the configurations a) and b) of FIG. 7 are shown. In the case of the first configuration, the two patches 31 and 32 are supplied in phase and the radiation pattern obtained is then the sum of the radiation diagrams of the two patches. This pattern shows a main lobe in the azimuthal plane and the associated directivity in this direction is then 9.3 dB. In the configuration 2, the patches are supplied in phase opposition. In this case, the radiation pattern is thus the difference of the radiation patterns of the patches. This pattern thus has a null in the azimuthal plane and two main lobes in the +/−60° planes. The directivity associated with these lobes is then 8 dB. The directivities obtained with this type of antenna are therefore much greater than the directivity obtained from the antennas with diversity of radiation according to the prior art.

It is evident to a person skilled in the art that the aforementioned examples are provided as an example.

The invention claimed is:

1. Transmission/reception antenna with diversity of radiation comprising on a substrate at least a first and a second radiating elements connected by a network of feeder lines to an electromagnetic signals transmission/reception circuit, characterized in that the network is constituted by only one first feeder line connected to the first radiating element and to a common feeder line and by a set of two second feeder lines, each second feeder line being connected by means of a switching element in a point of the second radiating element, the point of each second feeder line being positioned on the second radiating element in such a manner as the second radiating element is supplied to obtain phase opposition between said two points, the set of the two second feeder lines being connected to the first feeder line by a third feeder line, the first and the third feeder lines being connected directly by said common feeder line to the transmission/reception circuit of electromagnetic signals.

2. Antenna according to claim 1, wherein the radiating elements are constituted by slot type antennas.

3. Antenna according to claim 2, wherein the slot type antennas are constituted by annular slot or polygonal slot.

4. Antenna according to claim 2, wherein the slot type antennas are connected to the feeder lines by electromagnetic coupling.

5. Antenna according to claim 1, wherein the feeder lines are constituted by microstrip lines etched on the face of the substrate opposite the face carrying the slot type antennas.

6. Antenna according to claim 1, wherein the first feeder line has a length equal to the length of one of the second feeder lines plus the length of the third feeder line.

7. Antenna according to claim 1, wherein the radiating elements are constituted by antennas of the patch type.

8. Antenna according to claim 7, wherein the feeder lines are constituted by microstrip lines etched on the face of the substrate carrying the patch type antennas.

9. Antenna according to claim 1, characterized in that the switching elements are constituted by diodes, transistors, a switching circuit or MEMS (Micro Electro Mechanical System).

10. Antenna according to claim 9, wherein the diodes are mounted head to tail and controlled by a same voltage.

* * * * *